US009856778B2

(12) United States Patent
Tokozakura et al.

(10) Patent No.: US 9,856,778 B2
(45) Date of Patent: Jan. 2, 2018

(54) VEHICLE HEAT EXCHANGER

(71) Applicant: TOYOTA JIDOSHA KABUSHIKI KAISHA, Toyota (JP)

(72) Inventors: Daisuke Tokozakura, Susono (JP); Kazuya Arakawa, Fujinomiya (JP); Takahiro Shiina, Numazu (JP)

(73) Assignee: TOYOTA JIDOSHA KABUSHIKI KAISHA, Toyota-shi (JP)

( * ) Notice: Subject to any disclaimer, the term of this patent is extended or adjusted under 35 U.S.C. 154(b) by 0 days.

(21) Appl. No.: 15/217,528

(22) Filed: Jul. 22, 2016

(65) Prior Publication Data

US 2017/0030253 A1 Feb. 2, 2017

(30) Foreign Application Priority Data

Jul. 28, 2015 (JP) ..... 2015-148252

(51) Int. Cl.
*F01P 11/08* (2006.01)
*F28D 9/00* (2006.01)
*F28D 21/00* (2006.01)

(52) U.S. Cl.
CPC ..... *F01P 11/08* (2013.01); *F28D 9/005* (2013.01); *F28D 9/0093* (2013.01); *F01P 2060/045* (2013.01); *F28D 2021/0089* (2013.01)

(58) Field of Classification Search
CPC .. F01P 11/08; F01P 2060/045; F01P 2060/04; F01P 2025/40; F01P 7/165; F01P 3/18; F01P 2060/08; F28D 9/005; F28D 9/0093; F28D 2021/0089; F28F 27/02; F28F 2255/04; F28F 2250/06
See application file for complete search history.

(56) References Cited

U.S. PATENT DOCUMENTS 4,327,802 A * 5/1982 Beldam ..... F28D 1/0333 165/153
7,946,339 B2 * 5/2011 So ..... F28D 1/0246 165/140
9,581,367 B2 * 2/2017 Mann ..... F25B 39/00
(Continued)

FOREIGN PATENT DOCUMENTS

JP 2013-113578 6/2013
JP 2013-120054 6/2013

*Primary Examiner* — Hung Q Nguyen
(74) *Attorney, Agent, or Firm* — Oblon, McClelland, Maier & Neustadt, L.L.P.

(57) ABSTRACT

A heat exchanger includes first, second, third, and fourth passages. Engine coolant flows through the first passages. Engine oil flows through the second passages. Transmission oil flows through the fourth passages after flows through the third passages. Each first passage and each third passage is disposed in the same layer. Each second passage and each fourth passage is disposed in the same layer. Each first and each third passage are disposed in a different layer from the layer of each second and each fourths flow passage. Each fourth passage is disposed upstream of a first flow direction of the engine coolant in each first passage, and each second passage is disposed downstream of the first flow direction. Each third passage is disposed upstream of a second flow direction of the engine oil in each second passage, and each first passage is disposed downstream of the second flow direction.

5 Claims, 8 Drawing Sheets

(56) References Cited

U.S. PATENT DOCUMENTS

| | | | | |
|---|---|---|---|---|
| 2008/0142204 | A1* | 6/2008 | Vanden Bussche ... | F25J 1/0022 165/167 |
| 2008/0236802 | A1* | 10/2008 | Koepke ..... | F28D 9/005 165/167 |
| 2013/0133874 | A1 | 5/2013 | Kim et al. | |
| 2013/0140017 | A1 | 6/2013 | Kim | |
| 2014/0251579 | A1* | 9/2014 | Sloss ..... | F01N 5/02 165/96 |

* cited by examiner

VEHICLE HEAT EXCHANGER

INCORPORATION BY REFERENCE

The disclosure of Japanese Patent Application No. 2015-148252 filed on Jul. 28, 2015 including the specification, drawings and abstract is incorporated herein by reference in its entirety.

BACKGROUND

1. Technical Field

The present disclosure relates to a vehicle heat exchanger.

2. Description of Related Art

There are known vehicle heat exchangers that heat-exchange engine coolants with engine oils and transmission oils so as to adjust temperatures of the respective oils. For example, in Japanese Patent Application Publication No. 2013-113578 disclose a vehicle heat exchanger including stacked flow passages through which an engine coolant, an engine oil, and a transmission oil respectively flow, and enabling the respective fluids to be heat-exchanged with one another. In the vehicle heat exchanger of JP 2013-113578 A, heat exchange is carried out between the engine coolant and the engine oil as well as between the engine coolant and the transmission oil at the same time.

In the vehicle heat exchanger proposed in JP 2013-113578 A, the flow passages through which the engine oil flows and the flow passages through which the transmission oil flows are arranged with the flow passages through which the engine coolant flows located therebetween, so that the engine coolant is simultaneously heat-exchanged with the engine oil and the transmission oil. In other words, the engine coolant is heat-exchanged with the engine oil, and is also heat-exchanged with the transmission oil at the same time.

SUMMARY

In general, change in loss relative to change in oil temperature (e.g., degree of a loss torque of an engine and a transmission when an oil temperature is changed by 1° C.) in a transmission oil is greater than that in an engine oil. Hence, when the engine oil and the transmission oil are simultaneously heat-exchanged with the engine coolant, both of loss in accordance with change in oil temperature of the engine oil and loss in accordance with change in oil temperature of the transmission oil are change. Therefore, in light of enhancement of fuel efficiency, there is still room for improvement.

The present disclosure provides a vehicle heat exchanger capable of enhancing fuel efficiency of an entire power train.

An example aspect of the present disclosure provides a heat exchanger for a vehicle, the heat exchanger includes a plurality of plate bodies. The plurality of plate bodies are stacked together to constitute first passages, second passages, third passages, fourth passages and a communicating passage. The first passages are configured to flow an engine coolant through the first passages. The second passages are configured to flow an engine oil through the second passages. The third passages are configured to flow a transmission oil through the third passages. The fourth passages are configured to flow the transmission oil that has flowed through the third passages, through the fourth passages. The communicating passage is configured to communicate the third passages with the fourth passages. The first passages are configured to allow the engine coolant to be heat-exchanged with both the engine oil in the second passages and the transmission oil in the fourth passages via the plate bodies. The second passages are configured to allow the engine oil to be heat-exchanged with both the engine coolant in the first passages and the transmission oil in the third passages via the plate bodies. Each first passage is disposed in the same layer as a layer of each third passage. Each second passage is disposed in the same layer as a layer of each fourth passage. Each first passage and each third passage are disposed in a different layer from the layer of each second passage and each fourth passage. Each fourth passage is disposed upstream of a first flow direction of the engine coolant in each first passage. Each second passage is disposed downstream of the first flow direction of the engine coolant in each first passage. Each third passage is disposed upstream of a second flow direction of the engine oil in each second passage. Each first passage is disposed downstream of the second flow direction of the engine oil in each second passage.

Transmission oil has a greater variation in loss relative to the variation in oil temperature. According to the vehicle heat exchanger, the engine coolant is heat-exchanged with the transmission oil, and then the engine coolant is heat-exchanged with the engine oil. Thus, the transmission oil is preferentially heat-exchanged with the other fluids (e.g., the engine coolant and the engine oil). Accordingly, for example, in the transmission during warming-up, the oil temperature of the transmission oil is rapidly increased. Thus, according to the vehicle heat exchanger, the loss of the transmission can be reduced, and the fuel efficiency of the entire power train is enhanced.

For example, during high-speed drive or high-load drive of the vehicle, the transmission oil in each third passage is heat-exchanged with the engine oil in each second passage so as to decrease the temperature of the transmission oil. Thereafter, the transmission oil of which temperature is decreased in each fourth passage is heat-exchanged with the engine coolant of which temperature is lower than that of the engine oil in each first passage so as to rapidly cool the transmission oil of which temperature is higher than that of the engine oil. Thus, according to the vehicle heat exchanger, the loss of the transmission is reduced, and the fuel efficiency of the entire power train is enhanced.

In the vehicle heat exchanger, a first inflow port and a first outflow port of the engine coolant in the first passage, and a second inflow port and a second outflow port of the engine oil in the second passage may be arranged such that the first flow direction of the engine coolant in each first passage and the second flow direction of the engine oil in each second passage are counter-direction each other.

According to the vehicle heat exchanger, the direction in which the engine coolant flows and the direction in which the engine oil flows come into counter-flow relative to each other. Thus, the difference in temperature between the fluids partitioned by the plate bodies is maintained to be greater compared with the case of the co-flow. Thus, according to the vehicle heat exchanger, the engine coolant is efficiently heat-exchanged with the engine oil.

In the vehicle heat exchanger, a first inflow port and a first outflow port of the engine coolant in the first passage, and a fourth inflow port and a fourth outflow port of the transmission oil in the fourth passage may be arranged such that the first flow direction of the engine coolant in each first passage and a fourth flow direction of the transmission oil in each fourth passage are counter-direction each other.

According to the vehicle heat exchanger, the direction in which the engine coolant flows and the direction in which the transmission oil flows come into counter-flow relative to each other. Thus, the difference in temperature between the fluids partitioned by the plate bodies is maintained to be greater compared with the case of the co-flow. Thus, according to the vehicle heat exchanger, the engine coolant is efficiently heat-exchanged with the transmission oil.

In the heat exchanger, a second inflow port and a second outflow port of the engine oil in the second passage, and a third inflow port and a third outflow port of the transmission oil in the third passage may be arranged such that the second flow direction of the engine oil in each second passage and a third flow direction of the transmission oil in each third passage are counter-direction each other.

According to the vehicle heat exchanger, the direction in which the engine oil flows and the direction in which the transmission oil flows come into counter-flow relative to each other. Thus, the difference in temperature between the fluids partitioned by the plate bodies is maintained to be greater compared with the case of the co-flow. Thus, according to the vehicle heat exchanger, the engine oil is efficiently heat-exchanged with the transmission oil.

In the vehicle heat exchanger, a summed area of a third area and a fourth area may be greater than a second area, the second area is an area in a direction orthogonal to a stacking direction of the plate bodies in each second passage, the third area is an area in the direction orthogonal to the stacking direction of the plate bodies in each third passage, and the fourth area is an area in the direction orthogonal to the stacking direction of the plate bodies in each fourth passage.

According to the vehicle heat exchanger, in one of the engine oil and the transmission oil that has a lower oil temperature before completion of waiming-up of the engine and the transmission, a flow rate of the one is increased, thereby increasing the heat-exchange amount.

According to the vehicle heat exchanger, in one of the engine oil and the transmission oil that has a higher oil temperature during high-speed drive or high-load drive, a flow rate of the one is increased, thereby increasing the heat-exchange amount.

According to the vehicle heat exchanger of the present disclosure, the respective flow passages are arranged in consideration of the variation in loss relative to each variation in oil temperature of the engine oil and the transmission oil. Thus, the respective heat-exchange amounts of the engine coolant, the engine oil, and the transmission oil is optimized. Therefore, the loss of the engine and the transmission is reduced, and the fuel efficiency of the entire power train is enhanced.

BRIEF DESCRIPTION OF THE DRAWINGS

Features, advantages, and technical and industrial significance of exemplary embodiments will be described below with reference to the accompanying drawings, in which like numerals denote like elements, and wherein.

DETAILED DESCRIPTION OF EMBODIMENTS

Each vehicle heat exchanger according to respective embodiments will be described with reference to FIG. 1A to FIG. 12, hereinafter. Components in the following embodiments include components that are easily replaceable by those skilled in the art or substantially the same components.

Figure 1A:
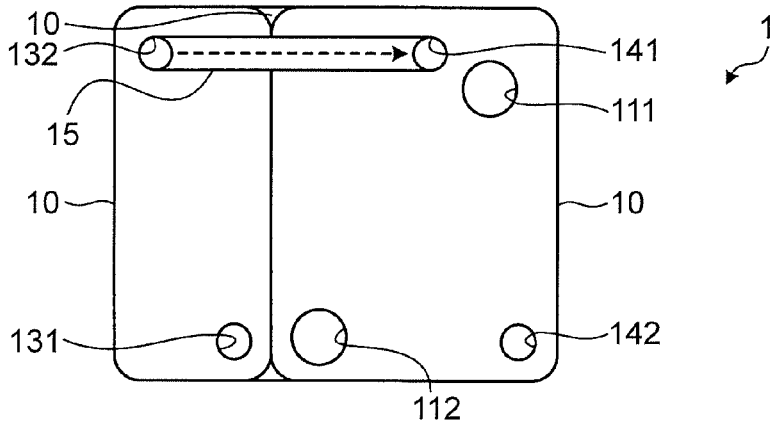
FIGS. 1A, 1B and 1C are schematic drawings schematically illustrating a configuration of a vehicle heat exchanger according to a first embodiment, and showing a plan view (FIG. 1A), a front view (FIG. 1B), and a bottom view (FIG. 1C) thereof in order from the top.
Figure 1B:
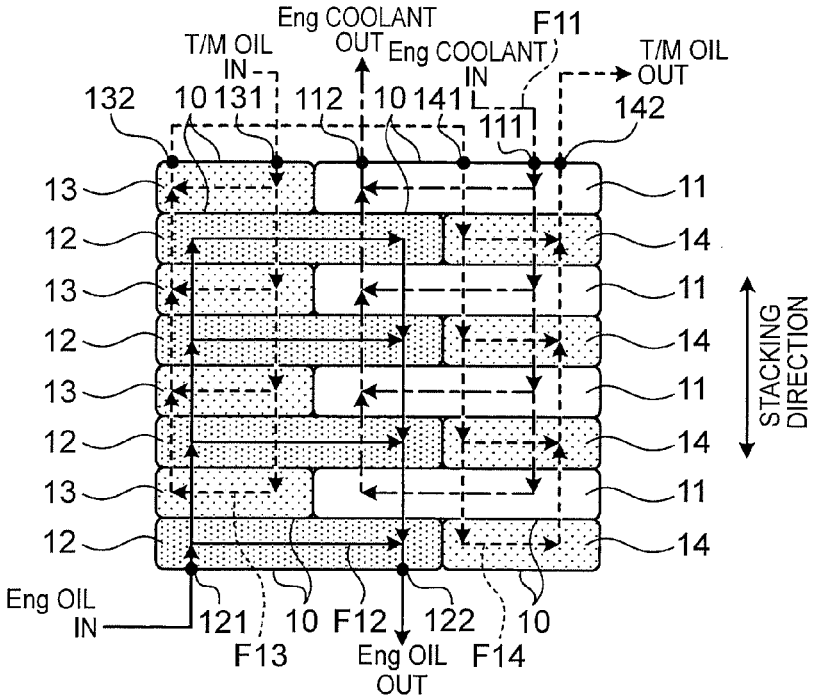
Figure 1C:
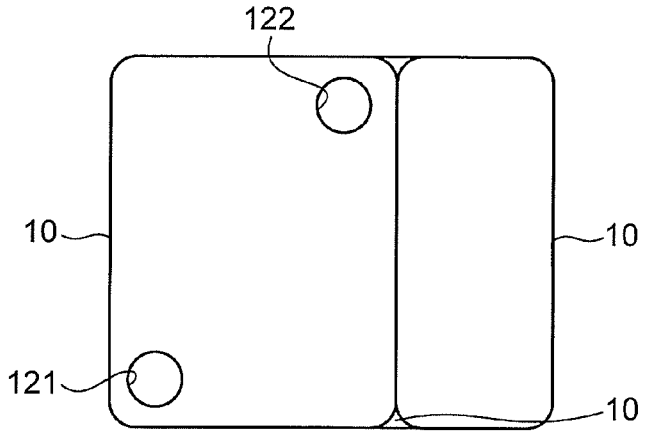

A vehicle heat exchanger according to the first embodiment is installed on a vehicle and is a so-called three-phase heat exchanger that heat-exchanges three types of fluids: an engine coolant (hereinafter, referred to as an Eng coolant); an engine oil (hereinafter, referred to as an Eng oil); and a transmission oil (hereinafter, referred to as a T/M oil) with one another. As shown in FIG. 1A to FIG. 1C, the vehicle heat exchanger 1 is a plate-stacking heat exchanger formed by stacking a plurality of plate bodies (also referred as plates) 10 made of metal, such as aluminum, and integrally joining these plate bodies. An example of a vehicle in which the vehicle heat exchanger 1 is installed may include an AT vehicle, a CVT vehicle, and an HV vehicle (also the same in a "vehicle" in the following descriptions). FIG. 1A to FIG. 1C mainly show flow passages of fluids that are heat-exchanged with one another in the vehicle heat exchanger 1, and configurations other than the flow passages are appropriately omitted or simplified.

As shown in FIG. 1B, in the vehicle heat exchanger 1, the plurality of plate bodies 10 are so stacked as to configure four types of flow passages including first passages 11, second passages 12, third passages 13, and fourth passages 14. As shown in FIG. 1A, the vehicle heat exchanger 1 also includes a communicating passage 15 that communicate the third passages 13 with the fourth passages 14.

Each "flow passage" denotes a space partitioned by the plate bodies 10. In FIG. 1B, a region corresponding to each first passage 11 is indicated by using no hatching, a region corresponding to each second passage 12 is indicated by using a dark dot hatching, and regions corresponding to the third passage 13 and the fourth passage 14 are indicated by using a light dot hatching, respectively. In FIG. 1B, each alternate long and short dash line arrow indicates a flow direction F11 of the Eng coolant in each first passage 11, each solid line arrow indicates a flow direction F12 of the Eng oil in each second passage 12, and respective broken line arrows indicate flow directions F13, F14 of the T/M oil in each third passage 13 and each fourth passage 14 (the same in respective arrows in the following drawings). The "flow direction" denotes a direction of flowing from an inflow port of each flow passage toward an outflow port thereof (see FIG. 6 to FIG. 8 described later).

Each first passage 11, each second passage 12, each third passage 13, and each fourth passage 14 are isolated and partitioned from one another by the plate bodies 10 so as to prevent the respective fluids flowing through the corresponding flow passages from being mixed to one another. As shown in FIG. 1B, the vehicle heat exchanger 1 is configured by eight layers in total, and each first passage 11 and each third passage 13 are adjacently arranged in each of the first, the third, the fifth, and the seventh layers from the top, and each second passage 12 and each fourth passage 14 are arranged adjacently in each of the second, the fourth, the sixth, and the eighth layers from the top, respectively. The vehicle heat exchanger 1 is configured such that the same type of the flow passages communicate with one another thereinside so that the same type of the fluids can flow in the stacking direction of the plate bodies 10. The specific configuration of the plate bodies 10 for embodying the above described flow passages will be described later; and first, the configuration of each flow passage will be described, hereinafter.

The first passages 11 are flow passages used for flowing the Eng coolant therethrough. As shown in FIG. 1A to FIG. 1C, the first passage 11 is formed on a part of a surface of each layer if the vehicle heat exchanger 1 is viewed in a plan view in a direction orthogonal to the stacking direction of the plate bodies 10, and formed with an area equivalent to the area of each second passage 12. The "area" herein denotes an area in a direction orthogonal to the stacking direction of the plate bodies 10 (the same in an "area" referred to in the following descriptions).

As shown in FIG. 1A and FIG. 1B, the plate body 10 configuring the uppermost part of the vehicle heat exchanger 1 is provided with a first inflow port 111 used for introducing the Eng coolant from the outside (engine) into the first passages 11, and a first outflow port 112 used for discharging the Eng coolant from the first passages 11 to the outside (engine). The Eng coolant introduced from the first inflow port 111 into the first passage 11 flows downward in the stacking direction of the plate bodies 10, and is split into each first passage 11 in each layer (the first, the third, the fifth, and the seventh layers from the top in FIG. 1B) The Eng coolant flows through the first passage 11 in each layer, and thereafter, flows upward in the stacking direction of the plate bodies 10 to be joined together, and flows out from the first outflow port 112 to the outside of the vehicle heat exchanger 1.

Although not-shown in the drawing, each of the plate bodies 10 configuring the first passage 11 in each layer is provided with an inter-layer communicating passage formed in a manner as to extend through each first passage 11 for the purpose of allowing the Eng oil to communicate between the second passages 12 arranged above and below each first passage 11. Similarly, the first passage 11 in each layer is provided with an inter-layer communicating passage formed in a manner as to extend through the first passage 11 in each layer for the purpose of allowing the T/M oil to communicate between the fourth passages 14 arranged above and below each first passage 11. These inter-layer communicating passages are respectively formed at positions indicated by solid lines orthogonal to the flow direction F11 of the Eng coolant in each first passage 11 (passages through which the Eng oil flows in the stacking direction), and at positions indicated by broken lines orthogonal to this flow direction F11 (passages through which the T/M oil flows in the stacking direction), as shown in FIG. 1B, for example.

The second passages 12 are flow passages used for flowing the Eng oil therethrough. As shown in FIG. 1A to FIG. 1C, each second passage 12 is formed on a part of a surface of each layer if the vehicle heat exchanger 1 is viewed in a plan view in the direction orthogonal to the stacking direction of the plate bodies 10, and formed with an area equivalent to the area of each first passage 11.

As shown in FIG. 1B, the plate body 10 configuring the lowermost part of the vehicle heat exchanger 1 is provided with a second inflow port 121 used for introducing the Eng oil from the outside (engine) into the second passages 12, and a second outflow port 122 used for discharging the Eng oil from the second passages 12 to the outside (engine). The Eng oil introduced from the second inflow port 121 into the second passage 12 flows upward in the stacking direction of the plate bodies 10, and is split into each second passage 12 in each layer (the first, the third, the fifth, and the seventh layers from the top in FIG. 1B). The Eng oil flows through the second passage 12 in each layer, and thereafter, flows downward in the stacking direction of the plate bodies 10 to be joined together, and flows out from the second outflow port 122 to the outside of the vehicle heat exchanger 1.

Although not shown in the drawing, each of the plate bodies 10 configuring the second passage 12 in each layer is provided with an inter-layer communicating passage formed in a manner as to extend through each second passage 12 for the purpose of allowing the Eng coolant to communicate between the first passages 11 arranged above and below each second passage 12. Similarly, the second passage 12 in each layer is provided with an inter-layer communicating passage formed in a manner as to extend through the second passage 12 for the purpose of allowing the T/M oil to communicate between the third passages 13 arranged above and below each second passage 12. The inter-layer communicating passages are respectively formed at positions indicated by alternate long and short dash lines orthogonal to the flow direction F12 of the Eng oil in each second passage 12 (passages through which the Eng coolant flows in the stacking direction), and at positions indicated by broken lines orthogonal to the flow direction F12 (passages through which the T/M oil flows in the stacking direction), as shown in FIG. 1B, for example.

The third passages 13 are flow passages used for flowing the T/M oil therethrough. As shown in FIG. 1A to FIG. 1C, each third passage 13 is formed on a part of a surface of each layer if the vehicle heat exchanger 1 is viewed in a plan view in the direction orthogonal to the stacking direction of the plate bodies 10, and formed with an area equivalent to the area of each fourth passage 14.

As shown in FIG. 1A and FIG. 1B, the plate body 10 configuring the uppermost part of the vehicle heat exchanger 1 is provided with a third inflow port 131 used for introducing the T/M oil from the outside (transmission) into the third passages 13, and a third outflow port 132 used for discharging the T/M oil from the third passages 13 to the communicating passage 15. The T/M oil introduced from the third inflow port 131 into the third passage 13 flows downward in the stacking direction of the plate bodies 10, and is split into each third passage 13 in each layer (the first, the third, the fifth, and the seventh layers from the top in FIG. 1B). The T/M oil flows through the third passage 13 in each layer, and thereafter, flows upward in the stacking direction of the plate bodies 10 to be joined together, and flows out from the third outflow port 132 to the communicating passage 15.

Although not-shown in the drawing, each of the plate bodies 10 configuring the third passage 13 in each layer is provided with an inter-layer communicating passage formed in a manner as to extend through each third passage 13 for the purpose of allowing the Eng oil to communicate between the second passages 12 arranged above and below each third passage 13. The inter-layer communicating passages are respectively formed at positions indicated by solid lines orthogonal to the flow direction F13 of the T/M oil in each third passage 13 (passages through which the Eng oil flows in the stacking direction), as shown in FIG. 1B, for example.

The fourth passages 14 are flow passages used for flowing the T/M oil having flowed through the third passages 13 therethrough. As shown in FIG. 1A to FIG. 1C, each fourth passage 14 is formed on a part of a surface of each layer if the vehicle heat exchanger 1 is viewed in a plan view in the direction orthogonal to the stacking direction of the plate bodies 10, and formed with an area equivalent to the area of each third passage 13.

As shown in FIG. 1B, the plate body 10 configuring the uppermost part of the vehicle heat exchanger 1 is provided with a fourth inflow port 141 used for introducing the T/M oil from the communicating passage 15 into the fourth passages 14, and a fourth outflow port 142 used for discharging the T/M oil from the fourth passages 14 to the outside (transmission). Specifically, the T/M oil previously heat-exchanged with the Eng oil in the third passages 13 is flowed into the fourth passage 14 via the communicating passage 15. The T/M oil introduced from the fourth inflow port 141 into the fourth passage 14 flows downward in the stacking direction of the plate bodies 10, and is split into each fourth passage 14 in each layer (the second, the fourth, the sixth, and the eighth layers from the top in FIG. 1B). The T/M oil flows through the fourth passages 14 in the respective layers, and thereafter, flows upward in the stacking direction of the plate bodies 10 to be joined together, and flows out from the fourth outflow port 142 to the outside of the vehicle heat exchanger 1.

Although not shown in the drawing, each of the plate bodies 10 configuring the fourth passage 14 in each layer is provided with an inter-layer communicating passage formed in a manner as to extend through each fourth passage 14 for the purpose of allowing the Eng coolant to communicate between the first passages 11 arranged above and below each fourth passage 14. The inter-layer communicating passages are respectively formed at positions indicated by alternate long and short dash lines orthogonal to the flow direction F13 of the T/M oil in each fourth passage 14 (passages through which the Eng coolant flows in the stacking direction), as shown in FIG. 1B, for example.

The communicating passage 15 is a flow passage configured to communicate the third passages 13 with the fourth passages 14. As shown in FIG. 1A, the communicating passage 15 is provided to extend from the third outflow port 132 to the fourth inflow port 141 so that the T/M oil flowing out from the third outflow port 132 flows through the communicating passage 15 into the fourth passages 14 from the fourth inflow port 141.

As shown in FIG. 1A and FIG. 1B, each first passage 11 and each third passage 13 are adjacently disposed in the same single layer which is different from the layer on which each second passage 12 and each fourth passage 14 are disposed. Each second passage 12 and each fourth passage 14 are adjacently disposed in the same single layer which is different from the layer on which each first passage 11 and each third passage 13 are disposed. Each layer where each first passage 11 and each third passage 13 are adjacently disposed (the first, the third, the fifth, and the seventh layers from the top in FIG. 1B) and each layer where each second passage 12 and each fourth passage 14 are adjacently disposed (the second, the fourth, the sixth, and the eighth layers from the top in FIG. 1B) are alternately arranged in the stacking direction of the plate bodies 10.

Each first passage 11 is configured to be in contact with a part of each second passage 12 and in contact with each entire fourth passage 14 via the plate bodies 10. Accordingly, the Eng coolant in each first passage 11 can mutually be heat-exchanged with both the Eng oil in each second passage 12 and the T/M oil in each fourth passage 14 via the plate bodies 10. Each second passage 12 is configured to be in contact with a part of each first passage 11 and in contact with each entire third passage 13 via the plate bodies 10. Accordingly, the Eng oil in each second passage 12 can mutually be heat-exchanged with both the Eng coolant in each first passage 11 and the T/M oil in each third passage 13 via the plate bodies 10. Each first passage 11 and each third passage 13 that are adjacent to each other in the same layer, and each second passage 12 and each fourth passage 14 that are adjacent to each other in the same layer are respectively isolated from each other by the plate bodies 10. Accordingly, no heat exchange is carried out between the Eng coolant flowing through each first passage 11 and the T/M oil flowing through each third passage 13, or between the Eng oil flowing through each second passage 12 and the T/M oil flowing through each fourth passage 14.

In the vehicle heat exchanger 1, as shown in FIG. 1A to FIG. 1C, each fourth passage 14 is disposed upstream of the flow direction F11 of the Eng coolant in each first passage 11, and each second passage 12 is disposed downstream of the flow direction F11 of the Eng coolant in each first passage 11. Hence, the Eng coolant flowing through each first passage 11 is first heat-exchanged with the T/M oil flowing through each fourth passage 14 via the plate bodies 10, and thereafter, is heat-exchanged with the Eng oil flowing through each second passage 12 via the plate bodies 10.

Figure 6:
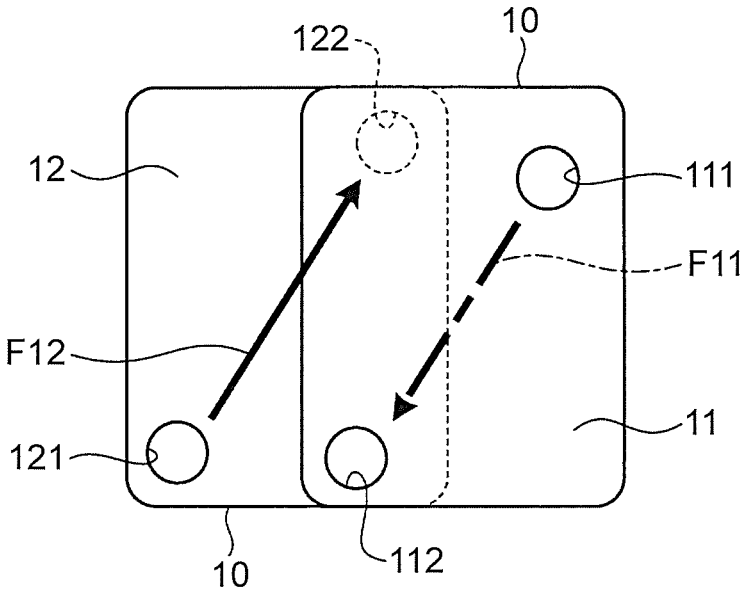
FIG. 6 is a drawing schematically illustrating a flow direction of the engine coolant in each first passage, and a flow direction of the engine oil in each second passage in the vehicle heat exchanger according to the first embodiment.
Figure 7:
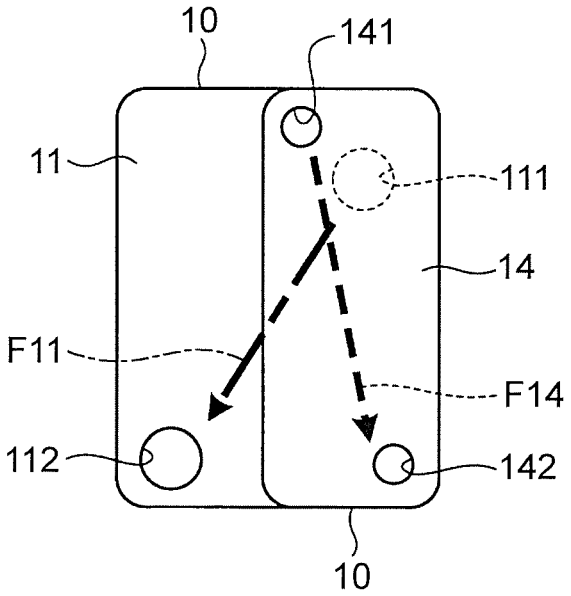
FIG. 7 is a drawing schematically showing the flow direction of the engine coolant in each first passage, and a flow direction of the transmission oil in each fourth passage in the vehicle heat exchanger according to the first embodiment.

"Upstream of the flow direction F11 of the Eng coolant" denotes a position on the side from which the Eng coolant flows in, and more specifically, this position denotes a position located on the first inflow port 111 side from which the Eng coolant flows in (see FIG. 6 and FIG. 7 for more details). "Downstream of the flow direction F11 of the Eng coolant" denotes a position on the side from which the Eng coolant flows out, and more specifically, this position denotes a position located on the first outflow port 112 side from which the Eng coolant flows out (see FIG. 6 and FIG. 7 for more details).

In the vehicle heat exchanger 1, as shown in FIG. 1A to FIG. 1C, each third passage 13 is disposed upstream of the flow direction F12 of the Eng oil in each second passage 12, and each first passage 11 is disposed downstream of the flow direction F12 of the Eng oil in each second passage 12. Hence, the Eng oil flowing through each second passage 12 is first heat-exchanged with the T/M oil flowing through each third passage 13 via the plate bodies 10, and thereafter, is heat-exchanged with the Eng coolant flowing through each first passage 11 via the plate bodies 10.

Figure 8:
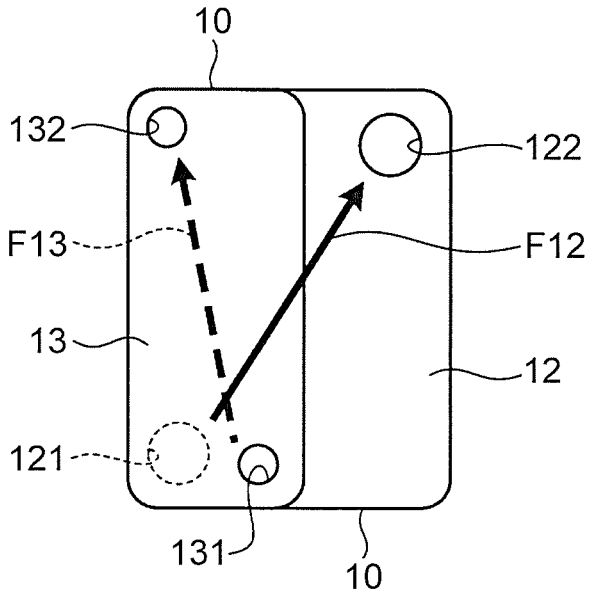
FIG. 8 is a drawing schematically showing the flow direction of the engine oil in each second passage, and a flow direction of the transmission oil in each third passage in the vehicle heat exchanger according to the first embodiment.

"Upstream of the flow direction F12 of the Eng oil" denotes a position on the side from which the Eng oil flows in, and more specifically, this position denotes a position located on the second inflow port 121 side from which the Eng oil flows in (see FIG. 6 and FIG. 8 for more details). "Downstream of the flow direction F12 of the Eng oil" denotes a position on the side from which the Eng oil flows out, and more specifically, this position denotes a position located on the second outflow port 122 side from which the Eng oil flows out (see FIG. 6 and FIG. 8 for more details).

Figure 2:
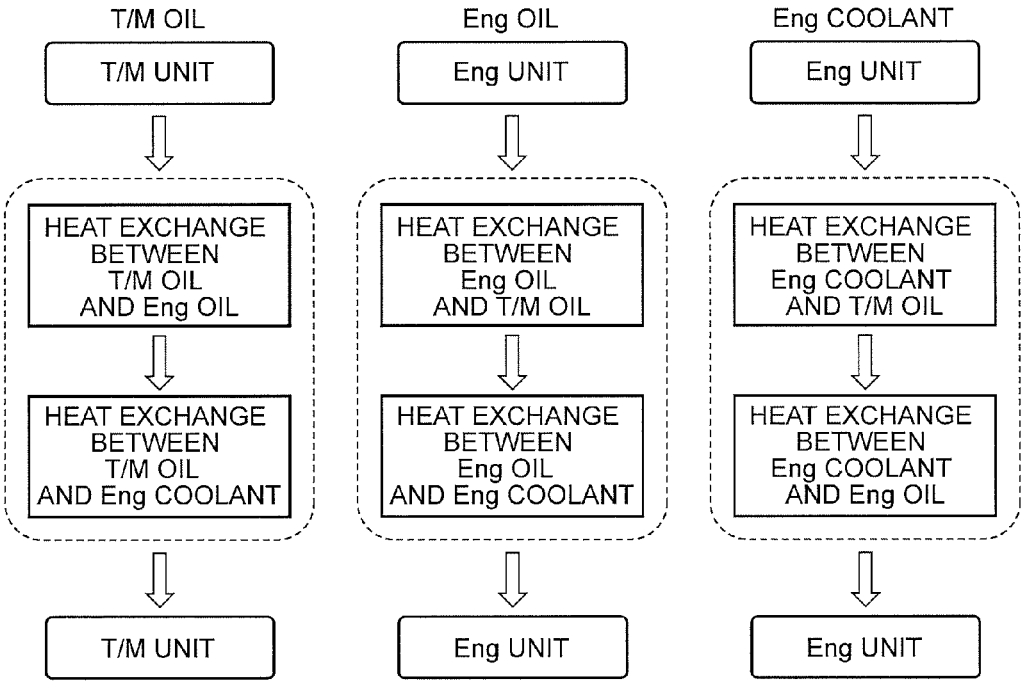
FIG. 2 is a drawing illustrating each step of heat exchange among an engine coolant, a transmission oil, and an engine oil in the vehicle heat exchanger according to the first embodiment.

The heat exchange procedures of the respective fluids in the corresponding flow passages of the vehicle heat exchanger 1 are collectively illustrated in FIG. 2. Specifically, as shown in FIG. 2, the T/M oil flowed from the T/M unit into each third passage 13 is first heat-exchanged with the Eng oil. The T/M oil then flows from the third passages 13 into the fourth passages 14 through the communicating passage 15, and thereafter is heat-exchanged with the Eng coolant, and is then returned into the T/M unit.

As shown in FIG. 2, the Eng oil flowed from an Eng unit into each second passage 12 is first heat-exchanged with the T/M oil, and subsequently is heat-exchanged with the Eng coolant, and is then returned into the Eng unit. As shown in FIG. 2, the Eng coolant flowed from the Eng unit flows into each first passage 11 is first heat-exchanged with the T/M oil, and subsequently the Eng coolant is heat-exchanged with the Eng oil, and is then returned into the Eng unit.

Figure 3:
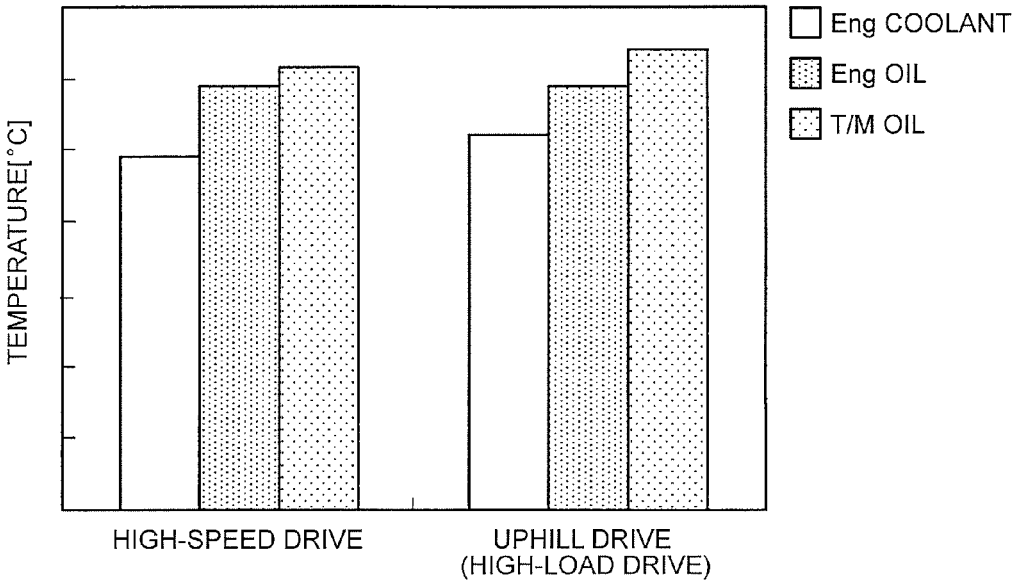
FIG. 3 is a graph showing each maximum temperature of the respective fluids during high-speed drive and uphill drive (high-load drive) of the vehicle.

FIG. 3 shows maximum temperatures of the respective fluids during high-speed drive and uphill drive of the vehicle. As shown in FIG. 3, during high-speed drive or during high-load drive, such as uphill drive, of the vehicle, the oil temperature of the T/M oil becomes higher than the oil temperature of the Eng oil. Hence, during the high-speed drive or the high-load drive of the vehicle, the T/M oil is required to be cooled more (have a lower temperature) than the Eng oil is; therefore, the heat-exchange amount between the Eng coolant and the T/M oil is required to be increased. Specifically, during the high-speed drive and the uphill drive of the vehicle, it is necessary to increase the cooling performance (heat-exchange amount) by the Eng coolant relative to the T/M oil rather than relative to the Eng oil. To attain this, in the vehicle heat exchanger 1, the Eng oil is first heat-exchanged with the T/M oil so as to cool the T/M oil, and thereafter the Eng coolant is heat-exchanged with the T/M oil, thereby efficiently cooling the T/M oil.

Figure 4:
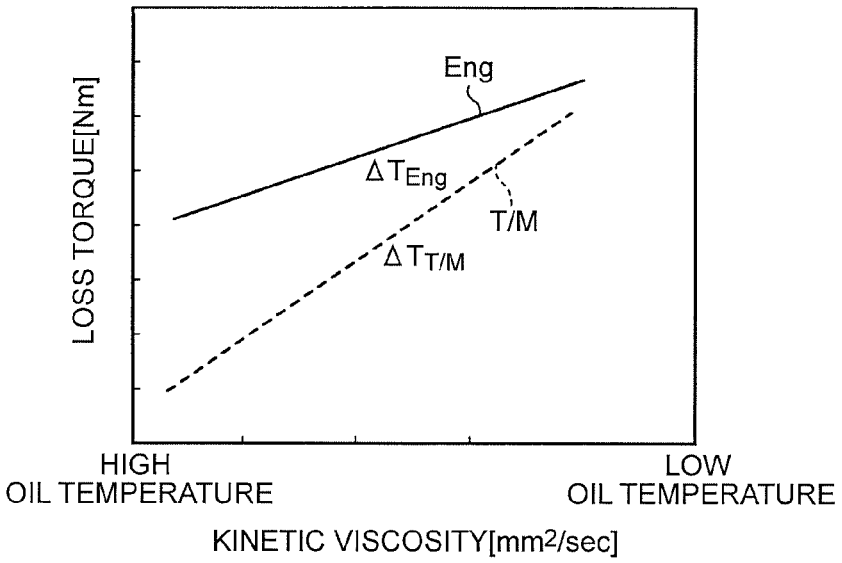
FIG. 4 is a graph showing a relation between respective loss torques of an engine and a transmission in the vehicle and respective kinetic viscosities of the engine oil and the transmission oil.

Meanwhile, as aforementioned, the degree of variation in loss relative to variation in oil temperature is different between the Eng oil and the T/M oil. For example, FIG. 4 shows respective relations between the loss torque and the oil temperature in the vehicle, and a vertical axis represents a loss torque, a horizontal axis represents a kinetic viscosity, a solid line represents a relation between a kinetic viscosity and a loss torque in the Eng oil, and a broken line represents a relation between a kinetic viscosity and a loss torque in the T/M oil. In FIG. 4, $\Delta T_{Eng}$ represents an inclination of the loss torque of the engine relative to the variation in kinetic viscosity, and $\Delta T_{Tim}$ represents an inclination of the loss torque of the transmission relative to the variation in kinetic viscosity.

In FIG. 4, although the horizontal axis does not represent the oil temperature but represents the kinetic viscosity, the kinetic viscosity has a temperature-dependency; therefore, FIG. 4 may be deemed to show the variation in loss relative to the variation in oil temperature. "(High Oil Temperature)" and "(Low Oil Temperature)" indicated on the right and the left of the horizontal axis represent that the kinetic viscosity becomes lower as the oil temperature becomes higher, and the kinetic viscosity becomes higher as the oil temperature becomes lower.

As shown in FIG. 4, in both the engine and the transmission, as the kinetic viscosity becomes decreased (the oil temperature becomes increased), the loss torque becomes decreased. Meanwhile, the inclination of the loss torque relative to the variation in oil temperature has a relation of $\Delta T_{T/M} > \Delta T_{Eng}$, and thus the inclination of the loss torque of the transmission is steeper than the inclination of the loss torque of the engine. Consequently, it is possible to reduce more loss torque of the entire power train, for example, by increasing the oil temperature of the T/M oil by 1° C. rather than increasing the oil temperature of the Eng oil by 1° C., thus improving fuel efficiency.

Figure 5:
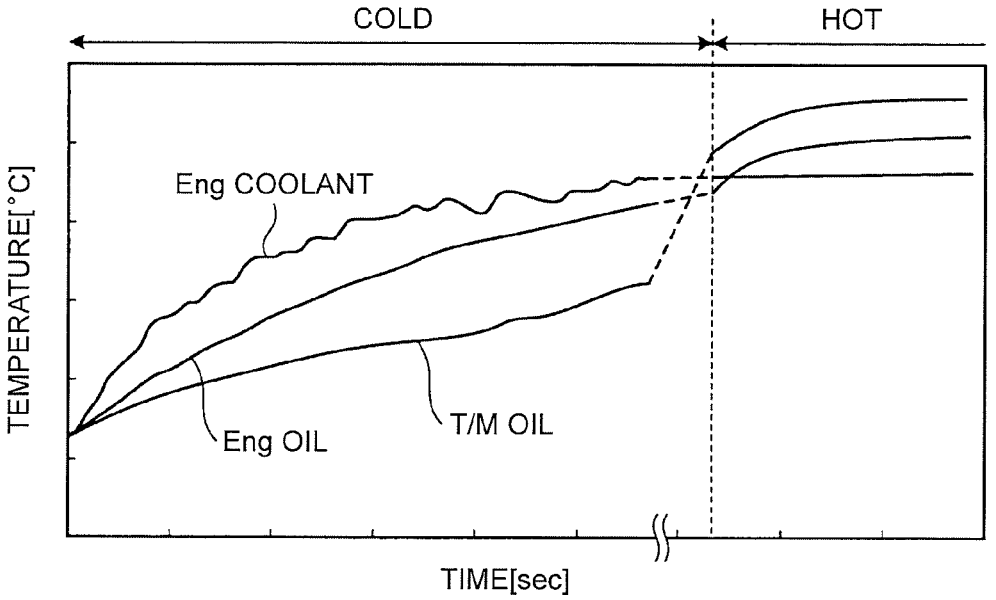
FIG. 5 is a graph showing each temperature transition of the respective fluids during a cold time indicating a state before the completion of warming-up (during warming-up) of the engine and the transmission in the vehicle, and during a hot time indicating a state after the completion of the warming-up of the engine and the transmission in the vehicle.

FIG. 5 shows each temperature transition of the respective fluids during a cold time indicating a state before completion of warming-up (during warming-up) of the engine and the transmission in the vehicle and during a hot time indicating a state after the completion of the warming-up of the engine and the transmission in the vehicle. In FIG. 5, a broken line indicates a time point when the warming-up is completed. As shown in FIG. 5, before the completion of the warming-up, the oil temperature of the T/M oil is lower than the oil temperature of the Eng oil. Hence, before the completion of the warming-up, it is necessary to increase the oil temperature of the T/M oil in preference to the oil temperature of the Eng oil so as to increase the heat-exchange amount between the Eng coolant and the T/M oil.

In this manner, both before and after the completion of the warming-up of the engine and the transmission in the vehicle, it is necessary to bring the T/M oil to be heat-exchanged with the other fluids in preference to the Eng oil, but in the vehicle heat exchanger proposed in JP 2013-113578A, each fluid is simultaneously heat-exchanged; therefore, it is impossible to prioritize the heat-exchange. The vehicle heat exchanger 1 is configured such that, as shown in FIG. 1A to FIG. 1C, each fourth passage 14 is disposed upstream of the flow direction F11 of the Eng coolant in each first passage 11, each second passage 12 is disposed downstream of the flow direction F11 of the Eng coolant in each first passage 11, each third passage 13 is disposed upstream of the flow direction F12 of the Eng oil in each second passage 12, and each first passage 11 is disposed downstream of the flow direction F12 of the Eng oil in each second passage 12 so as to efficiently heat-exchange the T/M oil with the other respective fluids.

In this manner, the vehicle heat exchanger 1 can preferentially heat-exchange the T/M oil having a greater variation in loss relative to the variation in oil temperature with the other fluids (the Eng coolant and the Eng oil) by first heat-exchanging the Eng coolant with the T/M oil, and thereafter heat-exchanging the Eng coolant with the Eng oil. Accordingly, for example, in the transmission during the warming-up, it is possible to rapidly increase the temperature of the T/M oil, thus reducing the loss of the transmission, and enhancing the fuel efficiency of the entire power train.

For example, during the high-speed drive or the high-load drive of the vehicle, the T/M oil in each third passage is heat-exchanged with the Eng oil in each second passage 12 so as to decrease the temperature of the T/M oil; and thereafter, the T/M oil of which temperature is decreased in each fourth passage 14 is heat-exchanged with the Eng coolant in each first passage 11 that has a lower temperature than that of the Eng oil so as to rapidly cool the T/M oil of which temperature is higher than that of the Eng oil, thereby reducing the loss of the transmission, and enhancing the fuel efficiency of the entire power train.

The flow direction of each fluid in the corresponding flow passage will be described with reference to FIG. 6 to FIG. 8, hereinafter. For example, in the vehicle heat exchanger 1 as shown in FIG. 1A to FIG. 1C, and FIG. 6 excerpts and illustrates only the first passage 11 and the second passage 12 adjacent to each other in the stacking direction of the plate bodies 10. For example, in the vehicle heat exchanger 1 as shown in FIG. 1A to FIG. 1C, and FIG. 7 excerpts and illustrates only the first passage 11 and the fourth passage 14 adjacent to each other in the stacking direction of the plate bodies 10. For example, in the vehicle heat exchanger 1 as shown in FIG. 1A to FIG. 1C, and FIG. 8 excerpts and illustrates only the second passage 12 and the third passage 13 adjacent to each other in the stacking direction of the plate bodies 10.

In each of FIG. 6 to FIG. 8, an alternate long and short dash line arrow indicates a main line (typical flow direction) of the flow direction F11 of the Eng coolant in the case of connecting the first inflow port 111 and the first outflow port 112 with a minimum distance. A solid line arrow indicates a main line of the flow direction F12 of the Eng oil in the case of connecting the second inflow port 121 and the second outflow port 122 with a minimum distance. Broken line arrows respectively indicate a main line of the flow direction F13 of the T/M oil in the case of connecting the third inflow port 131 and the third outflow port 132 with a minimum distance, and a main line of the flow direction F14 of the T/M oil in the case of connecting the fourth inflow port 141 and the fourth outflow port 142 with a minimum distance.

As shown in FIG. 6, in the vehicle heat exchanger 1, the first inflow port 111 and the first outflow port 112, and the second inflow port 121 and the second outflow port 122 are respectively formed in such a manner that the flow direction F11 of the Eng coolant in each first passage 11 and the flow direction F12 of the Eng oil in each second passage 12 are both in counter-flow relative to each other.

As shown in FIG. 6, the above "counter-flow" denotes a state in which main lines of respective flow directions of different fluids oppose each other, or in a state in which main lines of respective flow directions of different fluids intersect each other. Flows out of the counter-flow state, that is, flows in a state in which main lines of respective flow directions of different fluids do not oppose each other, and also in a state in which the main lines of the respective flow directions of the different fluids do not intersect each other are called as "co-flow".

Whether or not the flow direction F11 of the Eng coolant in each first passage 11 and the flow direction F12 of the Eng oil in each second passage 12 come into counter-flow is related to the positional relation among the first inflow port 111, the first outflow port 112, the second inflow port 121, and the second outflow port 122.

Specifically, as shown in FIG. 6, the first inflow port 111 and the first outflow port 112 are formed at respective diagonal positions of corners if the plate bodies 10 configuring the first passage 11 are viewed in a plan view. The second inflow port 121 and the second outflow port 122 are formed at respective diagonal positions of corners if the plate bodies 10 configuring the second passage 12 are viewed in a plan view, and at these positions, the main line of the flow direction F12 of the Eng oil opposes the main line of the flow direction F11 of the Eng coolant as viewed in a plan view. For example, in the plate body 10 in a rectangular shape as shown in FIG. 6, if the first inflow port 111 and the first outflow port 112 are formed at any diagonal positions of the four corners of the plate body 10, the second inflow port 121 and the second outflow port 122 are formed at diagonal positions of the four corners of the plate body 10 with a positional relation opposite to that of the first inflow port 111 and the first outflow port 112.

In this manner, in the vehicle heat exchanger 1, the main line of the flow direction F11 of the Eng coolant opposes the main line of the flow direction F12 of the Eng oil so that the flow direction of the Eng coolant and the flow direction of the Eng oil are both in counter-flow relative to each other; therefore, it is possible to maintain the difference in temperature among the fluids partitioned by the plate bodies 10 to be greater compared with the case of the co-flow, thus efficiently heat-exchanging the Eng coolant with the Eng oil.

For example, if the flow directions of the respective fluids are in co-flow, the difference in temperature between these fluids becomes greater on each inlet side (inflow port side) of the fluids, but the difference in temperature between these fluids becomes gradually smaller toward each outlet side (outflow port side) of the fluids; thus the heat exchange efficiency becomes reduced as a whole. To the contrary, if the flow directions of the respective fluids are in counter-flow relative to each other as with the present disclosure, the difference in temperature between these fluids becomes constant on each inlet side (inflow port side) of the fluids and on each outlet side (outflow port side) of the fluids; thus it is possible to maintain the difference in temperature between the fluids to be greater on an average, thus increasing the heat exchange efficiency as a whole.

As shown in FIG. 7, in the vehicle heat exchanger 1, the first inflow port 111 and the first outflow port 112, and the fourth inflow port 141 and the fourth outflow port 142 are respectively formed such that the flow direction F11 of the Eng coolant in each first passage 11 comes into counter-flow relative to the flow direction F14 of the T/M oil in each fourth passage 14.

Whether or not the flow direction F11 of the Eng coolant in each first passage 11 and the flow direction F14 of the T/M oil in each fourth passage 14 come into counter-flow is related to the positional relation among the first inflow port 111, the first outflow port 112, the fourth inflow port 141, and the fourth outflow port 142.

Specifically, as shown in FIG. 7, the first inflow port 111 and the first outflow port 112 are formed at diagonal positions of the corners if the plate bodies 10 configuring the first passage 11 are viewed in a plan view. The fourth inflow port 141 and the fourth outflow port 142 are formed at diagonal positions of corners if the plate bodies 10 configuring the fourth passage 14 are viewed in a plan view, and the main line of the flow direction F14 of the T/M oil is formed at a position intersecting the main line of the flow direction F11 of the Eng coolant as viewed in a plan view. For example, in the plate body 10 in a rectangular shape as shown in FIG. 7, if the first inflow port 111 and the first outflow port 112 are formed at any diagonal positions of the four corners of the plate body 10, the fourth inflow port 141 and the fourth outflow port 142 are formed at diagonal positions of the four corners that do not overlaid with the first inflow port 111 and the first outflow port 112 as viewed in a plan view.

In this manner, in the vehicle heat exchanger 1, the main line of the flow direction F11 of the Eng coolant intersects the main line of the flow direction F14 of the T/M oil so that the flow direction of the Eng coolant and the flow direction of the T/M oil are both in counter-flow relative to each other; therefore, it is possible to maintain the difference in temperature among the fluids partitioned by the plate bodies 10 to be greater compared with the case of the co-flow, thus efficiently heat-exchanging the Eng coolant with the T/M oil.

As shown in FIG. 8, in the vehicle heat exchanger 1, the second inflow port 121 and the second outflow port 122, and the third inflow port 131 and the third outflow port 132 are respectively formed in such a manner that the flow direction F12 of the Eng oil in each second passage 12 and the flow direction F13 of the T/M oil in each third passage 13 are in counter-flow relative to each other.

Whether or not the flow direction F12 of the Eng oil in each second passage 12 and the flow direction F13 of the T/M oil in each third passage 13 come into counter-flow is related to the positional relation among the second inflow port 121, the second outflow port 122, the third inflow port 131, and the third outflow port 132.

Specifically, as shown in FIG. 8, the second inflow port 121 and the second outflow port 122 are formed at diagonal positions of the corners if the plate bodies 10 configuring the second passage 12 are viewed in a plan view. The third inflow port 131 and the third outflow port 132 are formed at diagonal positions of the corners if the plate bodies 10 configuring the third passage 13 are viewed in a plan view, and the main line of the flow direction F13 of the T/M oil is formed at a position intersecting the main line of the flow direction F12 of the Eng oil as viewed in a plan view. For example, in the plate body 10 in a rectangular shape as shown in FIG. 8, if the second inflow port 121 and the second outflow port 122 are formed at any diagonal positions of the four corners of the plate body 10, the third inflow port 131 and the third outflow port 132 are formed at diagonal positions of the four corners that do not overlaid with the second inflow port 121 and the second outflow port 122.

In this manner, in the vehicle heat exchanger 1, the main line of the flow direction F12 of the Eng oil intersects the main line of the flow direction F13 of the T/M oil so that the flow direction of the Eng oil and the flow direction of the T/M oil are both in counter-flow relative to each other; therefore, it is possible to maintain the difference in temperature between the fluids partitioned by the plate bodies 10 to be greater compared with the case of the co-flow, thus efficiently heat-exchanging the Eng oil with the T/M oil.

Figure 9:
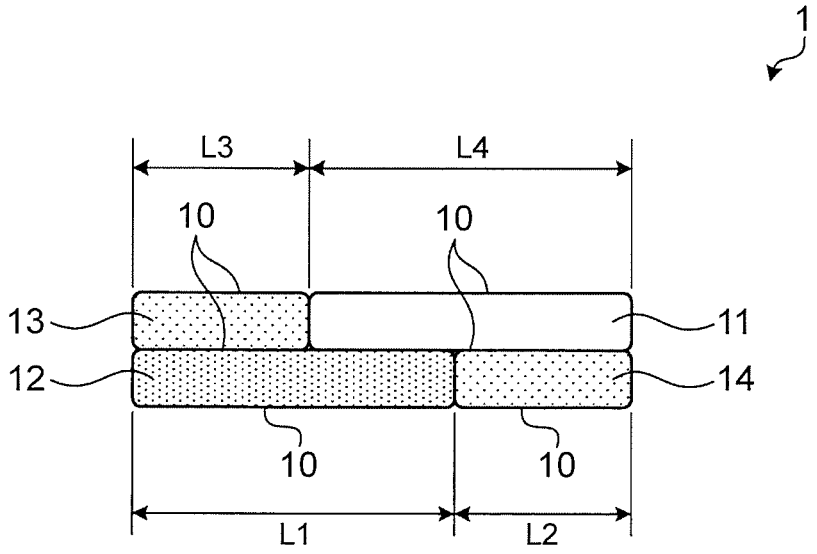
FIG. 9 is a schematic drawing showing a width of each flow passage in the vehicle heat exchanger according to the first embodiment.

The area of each flow passage in the vehicle heat exchanger 1 may be changed depending on the heat exchange amount required in each fluid, as shown in FIG. 9 for example, within a range in which the widths L1 to L4 of the flow passages in the respective layers satisfy "L1+L2=L3+L4", that is, within a range in which a sum of the width L1 of the second passage 12 and the width L2 of the fourth passage 14 is equal to a sum of the width L3 of the third passage 13 and the width L4 of the first passage 11 if the vehicle heat exchanger 1 is viewed in a front view. However, as aforementioned, in comparison of the area of each second passage 12 with the area of each third passage 13 and the area of each fourth passage 14, it is preferable that, in one of the Eng oil and the T/M oil that has a lower oil temperature before the completion of the warming-up of the engine and the transmission in the vehicle, or in one of these oils that has a higher oil temperature during high-speed drive or high-load drive of the vehicle, each flow passage of the one is set to have a greater area. The area referred to herein denotes an area in a direction orthogonal to the stacking direction of the plate bodies 10 as aforementioned.

As shown in FIG. 5, before the completion of the warming-up of the engine and the transmission in the vehicle, the oil temperature of the T/M oil becomes lower than the oil temperature of the Eng oil, and as shown in FIG. 3, during high-speed drive or high-load drive, such as uphill drive, of the vehicle, the oil temperature of the T/M oil becomes higher than the oil temperature of the Eng oil. Hence, as shown in FIG. 1A to FIG. 1C, and FIG. 9, the vehicle heat exchanger 1 is configured such that the sum of the area of each third passage 13 and the area of each fourth passage 14 is greater than the area of each second passage 12 so as to increase the flow rate of the T/M oil, thereby setting the heat-exchange amount between the T/M oil and the other fluids to be greater than the heat-exchange amount between the Eng oil and the other fluids.

In this manner, in the vehicle heat exchanger 1, by changing the area ratio of each second passage 12 through which the Eng oil flows relative to each third passage 13 and each fourth passage 14 both through which the T/M oil flows, it is possible to optimize the heat-exchange amount between the T/M oil and the other fluids without changing the entire dimension (width, height) of the vehicle heat exchanger 1.

The specific configurations of the vehicle heat exchanger 1, that is, the shape and the stacking method of the plate bodies 10 are not limited to specific ones, and the shape and the stacking method of the plate bodies 10 may be appropriately defined so as to provide the aforementioned arrangements of the respective flow passages; and an example thereof may include the case of utilizing dish-shaped plates.

In this case, the following three types of plates may be used as the plate bodies 10: large dish-shaped plates that partition the respective first passages 11 and the respective second passages 12; small dish-shaped plates that partition the respective third passages 13 and the respective fourth passages 14; and a flat plate that functions as an uppermost cover member, and these plates are combined (stacked) to form the respective flow passages. As the communicating passage 15, a pipe made of metal, such as aluminum, may be used, for example. The "dish-shape" herein denotes a shape in which a flat surface is formed to be concave, an aperture is formed above the concave portion, and there are a bottom surface and a side surface. An adhesive agent is applied between the plate bodies 10, and these plate bodies 10 are subjected to heat treatment or the like so as to be integrally bonded into the vehicle heat exchanger 1.

In the vehicle heat exchanger 1 having the aforementioned configuration, the respective flow passages are arranged in consideration of the variation in loss relative to each variation in oil temperature of the Eng oil and the T/M oil, thereby optimizing the respective heat-exchange amounts of the Eng coolant, the Eng oil, and the T/M oil; therefore, it is possible to reduce the loss of the engine and the transmission, and enhance the fuel efficiency of the entire power train.

In the vehicle heat exchanger as proposed in JP 2013-113578 A, each flow passage through which the Eng oil flows, each flow passage through which the Eng coolant flows, and each flow passage through which the T/M oil flows are stacked in this order; thus at least three layers are required to carry out the heat exchange among three types of fluids. To the contrary, in the vehicle heat exchanger 1 according to the present disclosure, each first passage 11 through which the Eng coolant flows and each third passage 13 through which the T/M oil flows are arranged in the same layer, and each second passage 12 through which the Eng oil flows and each fourth passage 14 through which the T/M oil flows are arranged in the same layer; and thus it is possible to carry out the heat exchange among three types of fluids in two layers. Accordingly, compared with the vehicle heat exchanger as disclosed in JP 2013-113578 A, in the vehicle heat exchanger 1, it is possible to reduce the number of the plate bodies 10 used for forming the flow passages of the respective fluids, thereby reducing the layers of the vehicle heat exchanger 1, and making the vehicle heat exchanger 1 compact.

In the vehicle heat exchanger as proposed in JP 2013-113578 A, since the heat exchange is simultaneously carried out among the Eng coolant, the Eng oil, and the T/M oil, the respective heat-exchange amounts of these fluids might be decreased, which results in deterioration of the fuel efficiency. Specifically, since the respective fluids flow in the corresponding layers in parallel, the flow rate of each fluid in each layer becomes decreased, and thus the heat exchange amount of each fluid becomes smaller. In particular, the T/M oil has a smaller flow rate than those of the Eng coolant and the Eng oil; therefore, in the vehicle heat exchanger as described in JP 2013-113578 A, it might be impossible to satisfy the required heat-exchange amount. Even if the flow passages are designed to satisfy the heat-exchange amount required in the T/M oil having the smallest flow rate, in the case of the vehicle heat exchanger of JP 2013-113578 A, the respective flow passages through which the fluids other than the T/M oil flow necessarily become enlarged in accordance with increase in dimension of the flow passage through which the T/M oil flows, which results in increase in dimension of the entire heat exchanger. To the contrary, the vehicle heat exchanger 1 of the present embodiment is configured such that the respective flow passages are so arranged as to satisfy the heat-exchange amount required in the T/M oil; therefore, it is possible to suppress increase in dimension of the entire heat exchanger.

In the vehicle heat exchanger as described in JP 2013-113578 A, it is impossible to arrange all the flow directions of the respective fluids to be in counter-flow relative to one another, so that some of the fluids come into co-flow. To the contrary, in the vehicle heat exchanger 1, as shown in FIG. 1A to FIG. 1C, each fourth passage 14 is arranged upstream of the flow direction F11 of the Eng coolant in each first passage 11, each second passage 12 is arranged downstream of the flow direction F11 of the Eng coolant in each first passage 11, each third passage 13 is arranged upstream of the flow direction F12 of the Eng oil in each second passage 12, and each first passage 11 is arranged downstream of the flow direction F12 of the Eng oil in each second passage 12, thereby arranging all the flow directions of the respective fluids to be in counter-flow relative to one another. Accordingly, in the vehicle heat exchanger 1, the respective fluids can be more efficiently heat-exchanged with one another, compared with the vehicle heat exchanger as described in JP 2013-113578 A in which some of the flow passages are arranged in co-flow.

In the vehicle heat exchanger as proposed in JP 2013-113578 A, the number of the plate bodies configuring each flow passage is identical; thus it is impossible to set the heat-exchange amount of each fluid to be an optimum value, which causes deficiency and excess of the heat-exchange amount. To the contrary, the vehicle heat exchanger 1 can set the heat-exchange amount of each fluid to be an optimum value by appropriately arranging the location of each flow passage.

The second embodiment will be described. In the aforementioned vehicle heat exchanger 1, as shown in FIG. 1A to FIG. 1C, the T/M oil introduced from the third inflow port 131 is split into the respective third passages 13 arranged in the plural layers, and the T/M oil flows in the same direction in all the third passages 13 of the respective layers; but the third passages 13 may be formed in a meandering structure (multipath structure). Specifically, as shown in FIG. 10, a vehicle heat exchanger 1A according to the second embodiment of the present disclosure is configured such that the flow direction F13 of the T/M oil in each third passage 13 meanders between each third passage 13 of each layer so as to bring the T/M oil in the third passages 13 of the respective layers to flow in a different direction from one another.

As aforementioned, in a three-phase vehicle heat exchanger, the flow rate of the T/M oil is generally smaller than the flow rate of the Eng coolant and the flow rate of the Eng oil. In the case of the aforementioned vehicle heat exchanger 1, the T/M oil introduced from the third inflow port 131 is split into the respective third passages 13 arranged in the plural layers, so that the flow rate of the T/M oil that is originally smaller is further divided. Hence, depending on the amount of the T/M oil introduced from the third inflow port 131, a desired heat-exchange amount cannot be secured in some cases. As described above in FIG. 3 and FIG. 5, in the three-phase vehicle heat exchanger, it has been demanded to increase the heat-exchange amount between the Eng coolant and the T/M oil as much as possible.

Figure 10:
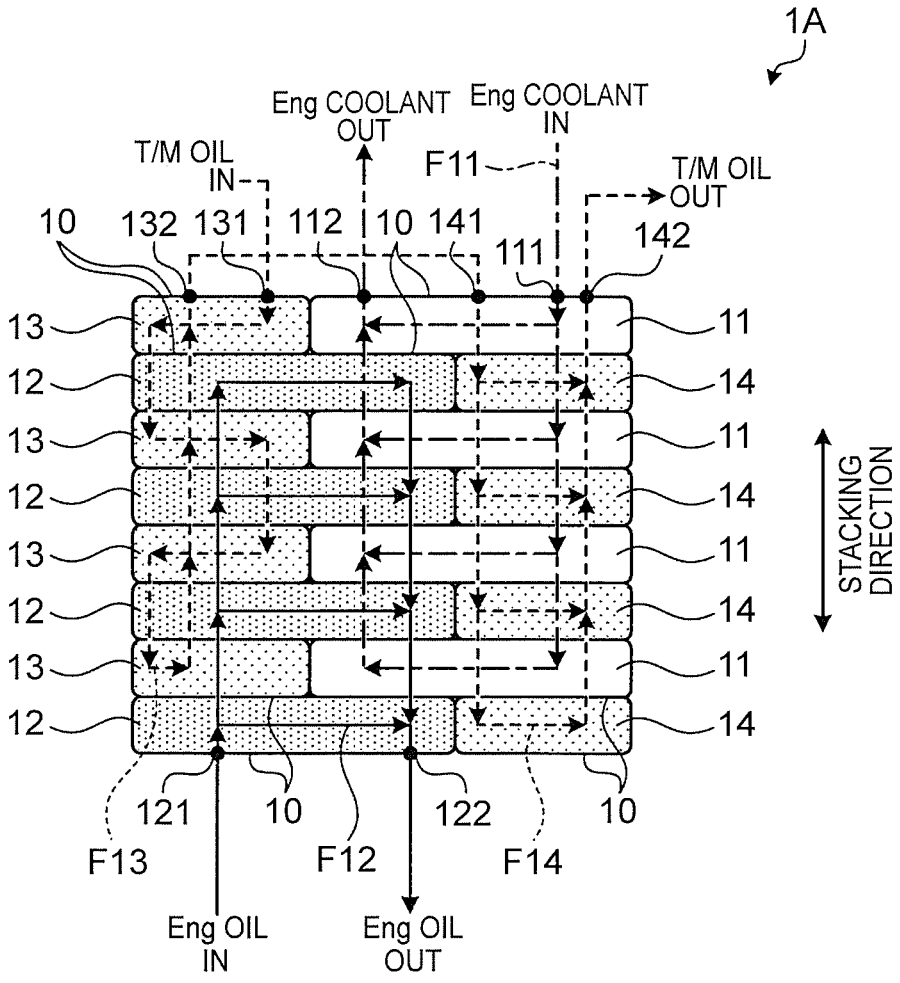
FIG. 10 is a schematic drawing schematically showing a configuration of a vehicle heat exchanger according to a second embodiment.

To cope with this, as shown in FIG. 10, in the vehicle heat exchanger 1A, the third passages 13 are configured in the meandering structure. Specifically, in the vehicle heat exchanger 1A, the T/M oil introduced from the third inflow port 131 that is formed in the uppermost plate body 10 flows through the third passage 13 of the first layer from the top as viewed in a front view, in a direction from the third inflow port 131 toward the third outflow port 132, flows through the not-shown inter-layer communicating passage formed in the second passage 12 of the second layer from the top into the third passage 13 of the third layer from the top. Subsequently, the T/M oil flows through the third passage 13 of the third layer from the top as viewed in a front view, in a direction from the third outflow port 132 toward the third inflow port 131, and then flows through the not-shown inter-layer communicating passage formed in the second passage 12 of the fourth layer from the top into the third passage 13 of the fifth layer from the top. Subsequently, the T/M oil flows through the third passage 13 of the fifth layer from the top as viewed in a front view, in the direction from the third inflow port 131 toward the third outflow port 132, and then flows through the not-shown inter-layer communicating passage formed in the second passage 12 of the sixth layer from the top into the third passage 13 of the seventh layer from the top. Subsequently, the T/M oil flows through the third passage 13 of the seventh layer from the top as viewed in a front view, in the direction from the third outflow port 132 toward the third inflow port 131, flows upward in the stacking direction of the plate bodies 10, and flows out from the third outflow port 132 formed in the uppermost plate body 10.

As aforementioned, according to the vehicle heat exchanger 1A, while the flow amount of the T/M oil introduced from the third inflow port 131 is not split, the T/M oil flows through the third passages 13 in the respective layers from one layer to another layer. Accordingly, it is possible to increase the heat-exchange amount between the Eng oil and the T/M oil. It is also possible to optimize the heat-exchange amount between the Eng oil and the T/M oil without changing the dimension (width, height) of the entire vehicle heat exchanger 1A.

A choice of employment between the meandering structure of the third passages 13 as with the vehicle heat exchanger 1A and the split structure of the third passages 13 as with the aforementioned vehicle heat exchanger 1 may be made depending on the supposed flow rate of the T/M oil; and if the flow rate of the T/M oil is not less than a predetermined flow rate, the third passages 13 may be formed in the split structure as with the vehicle heat exchanger 1, and if the flow rate of the T/M oil is less than the predetermined flow rate, the third passages 13 may be formed in the meandering structure as with the vehicle heat exchanger 1A.

Figure 11:
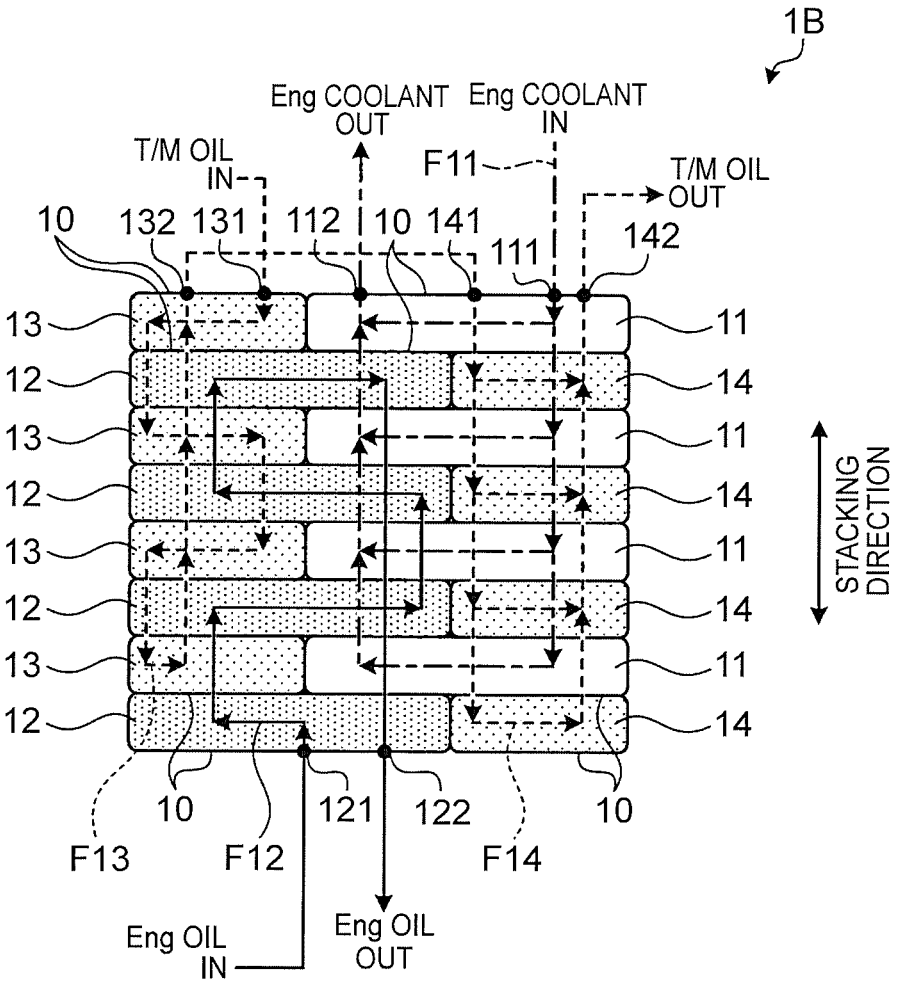
FIG. 11 is a schematic drawing schematically showing a configuration of a vehicle heat exchanger according to a third embodiment.

The third embodiment will be described, hereinafter. As shown in FIG. 10, in the aforementioned vehicle heat exchanger 1A, only the third passages 13 through which the T/M oil flows are formed in a meandering structure, but the second passages 12 through which the Eng oil flows may also be formed in a meandering structure. Specifically, as shown in FIG. 11, a vehicle heat exchanger 1B according to the third embodiment of the present disclosure is configured such that the flow direction F12 of the Eng oil in the second passages 12 in the respective layers meanders between each second passage 12 of each layer, and thus the Eng oil flows in different directions in the second passages 12 of the respective layers.

In the vehicle heat exchanger 1B, the Eng oil introduced from the second inflow port 121 that is formed in the lowermost plate body 10 flows through the second passage 12 of the first layer from the bottom as viewed in a front view, in a direction from the second outflow port 122 toward the second inflow port 121, flows through the not-shown inter-layer communicating passage formed in the third passage 13 of the second layer from the bottom into the second passage 12 of the third layer from the bottom. Subsequently, the Eng oil flows through the second passage 12 of the third layer from the bottom as viewed in a front view, in a direction from the second inflow port 121 toward the second outflow port 122, and then flows through the not-shown inter-layer communicating passage formed in the first passage 11 of the fourth layer from the bottom into the second passage 12 of the fifth layer from the bottom. Subsequently, the Eng oil flows through the second passage 12 of the fifth layer from the bottom as viewed in a front view, in the direction from the second outflow port 122 toward the second inflow port 121, and then flows through the not-shown inter-layer communicating passage formed in the third passage 13 of the sixth layer from the bottom into the second passage 12 of the seventh layer from the bottom. Subsequently, the Eng oil flows through the second passage 12 of the seventh layer from the bottom as viewed in a front view, in the direction from the second inflow port 121 toward the second outflow port 122, flows downward in the stacking direction of the plate bodies 10, and flows out from the second outflow port 122 formed in the lowermost plate body 10.

In this manner, in the vehicle heat exchanger 1B, the second passages 12 and the third passages 13 are both formed in the meandering structure, thereby bringing almost all the flow direction F13 of the T/M oil in each third passage 13 and almost all the flow direction F12 of the Eng oil in each third passage 13 to be in counter-flow relative to each other, thereby efficiently heat-exchanging the respective fluids with one another.

A choice of employing the meandering structure in the second passages 12 and the third passages 13 as with the vehicle heat exchanger 1B or the split structure only in the second passages 12 as with the vehicle heat exchanger 1A may be made depending on the requirement of necessary heat exchange.

Figure 12:
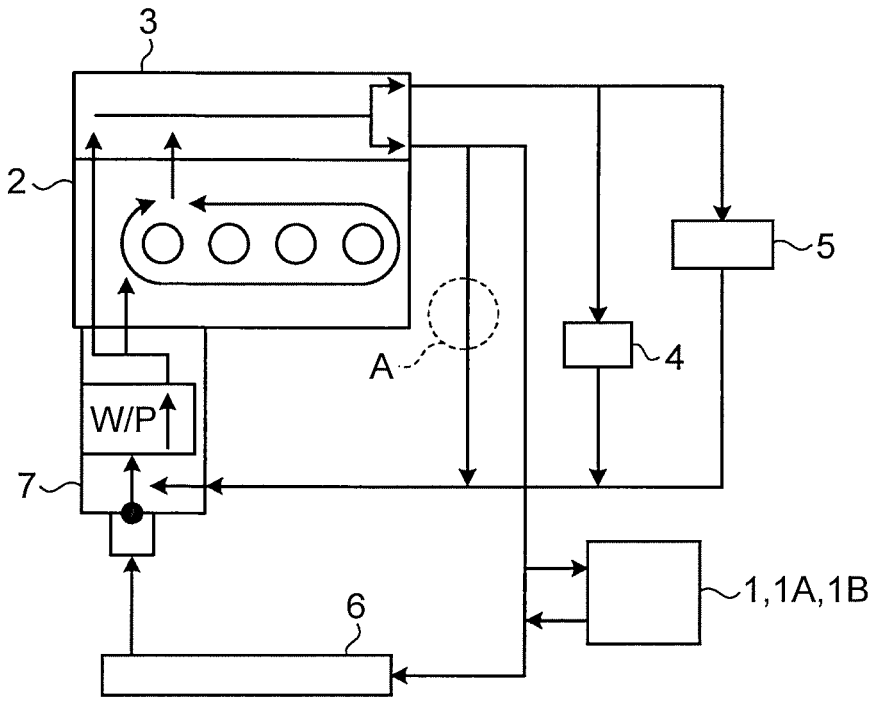
FIG. 12 is a drawing showing an example of an arrangement position of the vehicle heat exchanger according to each embodiment in the vehicle.

It is preferable to arrange the aforementioned vehicle heat exchanger 1, 1A, 1B at a position at which the flow rate of the Eng coolant is greater in the vehicle, and may be disposed in a radiator passage, as shown in FIG. 12, for example. In FIG. 12, there are respectively illustrated a cylinder block 2, a cylinder head 3, a throttle body 4, a heater 5, a radiator 6, and a thermostat 7 of the engine in the vehicle. In FIG. 12, each arrow illustrated between each two adjacent component elements indicates a passage through which each fluid (the Eng coolant, the Eng oil, the T/M oil) flows. The "flow rate of the Eng coolant is greater" denotes the case of the Eng coolant having an average flow rate of not less than 6 L/min, for example.

As shown in FIG. 12, the vehicle heat exchanger 1, 1A, 1B is disposed in the vicinity of an inlet of the radiator 6 so as to supply the vehicle heat exchanger 1, 1A, 1B with more Eng coolant, thereby enhancing the heat exchange amount of each fluid. In the case of disposing the vehicle heat exchanger 1, 1A, 1B at the position as shown in FIG. 12, the thermostat 7 is in a closed state before the completion of the engine warming-up, which means that the Eng coolant is not sufficiently heated, and thus the vehicle heat exchanger 1, 1A, 1B is supplied with no Eng coolant, and no heat exchange is carried out among the respective fluids. On the other hand, after the completion of the engine warming-up, and if the Eng coolant is sufficiently heated, the thermostat 7 is opened so as to supply the vehicle heat exchanger 1, 1A, 1B with the Eng coolant, and thus the heat exchange is carried out among the respective fluids. Accordingly, if the vehicle heat exchanger 1, 1A, 1B is disposed at the position as shown in FIG. 12, it is possible to automatically carry out switching between execution and inexecution of the heat exchange among the respective fluids before and after the completion of the engine warming-up.

In general, before the completion of the engine warming-up, it is preferable to preferentially increase the temperature of the Eng coolant in light of enhancement of the fuel efficiency; therefore, as shown in FIG. 12, the vehicle heat exchanger 1, 1A, 1B is disposed in the vicinity of the inlet of the radiator 6 so as to enhance the fuel efficiency.

Besides the above position, the vehicle heat exchanger 1, 1A, 1B may be disposed at a position immediately after the cylinder head 3 as indicated by a reference sign A of FIG. 12. The flow rate of the Eng coolant is also great enough at this position to enhance the heat-exchange amount of each fluid. In this case, the second inflow port 121 and the second outflow port 122 may be directly mounted to the cylinder head 3, for example.

As described above, the specific embodiments of the respective vehicle heat exchangers have been explained, but the spirit of the heat exchanger should not be limited to the above descriptions, but rather be construed broadly within its spirit and scope of the claims. It is needless to mention that various changes and modifications made based on these descriptions may be included in the spirit of the heat exchanger.

For example, in FIG. 1, FIG. 10, and FIG. 11 as described above, there has been explained each vehicle heat exchanger 1, 1A, 1B having eight layers in total configured by alternately arranging, in the stacking direction of the plate bodies 10, the layers, each including each first passage 11 and each third passage 13 that are adjacently disposed, and the layers, each including each second passage 12 and each fourth passage 14 that are adjacently disposed; however, the number of layers of each vehicle heat exchanger 1, 1A, 1B may be eight or more, or eight or less as far as the layers, each including each first passage 11 and each third passage 13 that are adjacently disposed, and the layers, each including each second passage 12 and each fourth passage 14 that are adjacently disposed are alternately arranged.

What is claimed is:

1. A heat exchanger for a vehicle, the heat exchanger comprising a plurality of plate bodies stacked together to constitute first passages, second passages, third passages, fourth passages and a communicating passage, the first passages being configured to flow an engine coolant through the first passages, the second passages being configured to flow an engine oil through the second passages, the third passages being configured to flow a transmission oil through the third passages, the fourth passages being configured to flow the transmission oil that has flowed through the third passages, through the fourth passages, and the communicating passage being configured to communicate the third passages with the fourth passages, wherein the first passages are configured to allow the engine coolant to be heat-exchanged with both the engine oil in the second passages and the transmission oil in the fourth passages via the plate bodies, the second passages are configured to allow the engine oil to be heat-exchanged with both the engine coolant in the first passages and the transmission oil in the third passages via the plate bodies, each first passage is disposed in the same layer as a layer of each third passage, each second passage is disposed in the same layer as a layer of each fourth passage, each first passage and each third passage are disposed in a different layer from the layer of each second passage and each fourth passage, each fourth passage is disposed upstream of a first flow direction of the engine coolant in each first passage, each second passage is disposed downstream of the first flow direction of the engine coolant in each first passage, each third passage is disposed upstream of a second flow direction of the engine oil in each second passage, and each first passage is disposed downstream of the second flow direction of the engine oil in each second passage.

2. The heat exchanger according to claim 1, wherein a first inflow port and a first outflow port of the engine coolant in the first passage, and a second inflow port and a second outflow port of the engine oil in the second passage are arranged such that the first flow direction of the engine coolant in each first passage and the second flow direction of the engine oil in each second passage are counter-direction each other.

3. The heat exchanger according to claim 1, wherein a first inflow port and a first outflow port of the engine coolant in the first passage, and a fourth inflow port and a fourth outflow port of the transmission oil in the fourth passage are arranged such that the first flow direction of the engine coolant in each first passage and a fourth flow direction of the transmission oil in each fourth passage are counter-direction each other.

4. The heat exchanger according to claim 1, wherein a second inflow port and a second outflow port of the engine oil in the second passage, and a third inflow port and a third outflow port of the transmission oil in the third passage are arranged such that the second flow direction of the engine oil in each second passage and a third flow direction of the transmission oil in each third passage are counter-direction each other.

5. The heat exchanger according to claim 1, wherein a summed area of a third area and a fourth area is greater than a second area, the second area is an area in a direction orthogonal to a stacking direction of the plate bodies in each second passage, the third area is an area in the direction orthogonal to the stacking direction of the plate bodies in each third passage, and the fourth area is an area in the direction orthogonal to the stacking direction of the plate bodies in each fourth passage.

* * * * *